United States Patent [19]

Chervenak et al.

[11] 4,111,788

[45] Sep. 5, 1978

[54] STAGED HYDROGENATION OF LOW RANK COAL

[75] Inventors: Michael C. Chervenak, Pennington; Edwin S. Johanson, Princeton, both of N.J.

[73] Assignee: Hydrocarbon Research, Inc., Lawrenceville, N.J.

[21] Appl. No.: 725,854

[22] Filed: Sep. 23, 1976

[51] Int. Cl.[2] ..... C10G 1/08

[52] U.S. Cl. ..... 208/10

[58] Field of Search ..... 208/10

[56] References Cited

U.S. PATENT DOCUMENTS

| | | | |
|---|---|---|---|
| Re. 25,770 | 4/1965 | Johanson | 208/10 |
| 3,488,279 | 1/1970 | Schulman | 208/10 X |
| 3,617,465 | 11/1971 | Wolk et al. | 208/8 |
| 3,679,573 | 7/1972 | Johnson | 208/10 |
| 3,700,584 | 10/1972 | Johanson et al. | 208/10 |
| 3,884,795 | 4/1975 | Wright et al. | 208/8 |

*Primary Examiner*—Delbert E. Gantz

*Assistant Examiner*—Joan Thierstein

*Attorney, Agent, or Firm*—Michael A. Jacobs

[57] ABSTRACT

The hydrogenation of low rank coal to produce hydrocarbon liquids and gases is conducted in a first stage reaction zone at elevated temperature and pressure and without catalyst, followed by further hydrogenation of the total effluent in a second stage ebullated bed catalytic reaction zone which is maintained at slightly lower temperature. The first stage may comprise an ebullated bed of high density non-catalytic contact material. However, the presence of such contact material is not required. Clarified hydrocarbon liquid streams are returned to the first stage reaction zone as the slurrying oil and to the second stage zone as recycle oil to maintain a significantly high percentage of unconverted coal solids in the first stage reaction zone than in the second stage zone. This two stage reaction arrangement produces a high percentage conversion of the low rank coal to liquid and gaseous products with good process operability.

21 Claims, 1 Drawing Figure

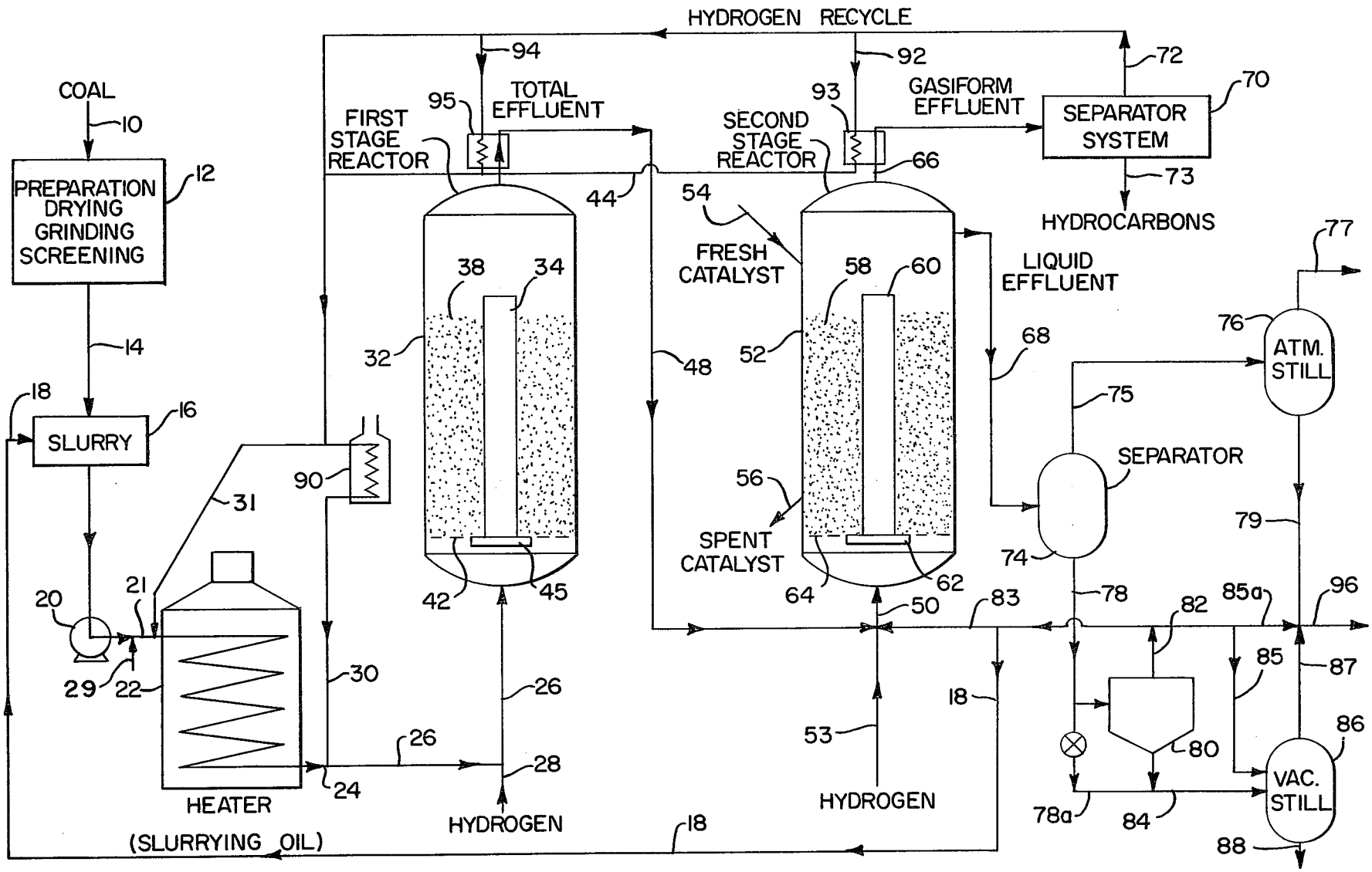
COAL
PREPARATION DRYING GRINDING SCREENING
SLURRY
HEATER
(SLURRYING OIL)
FIRST STAGE REACTOR
SECOND STAGE REACTOR
TOTAL EFFLUENT
HYDROGEN RECYCLE
GASIFORM EFFLUENT
SEPARATOR SYSTEM
HYDROCARBONS
LIQUID EFFLUENT
FRESH CATALYST
SPENT CATALYST
HYDROGEN
SEPARATOR
ATM. STILL
VAC. STILL

STAGED HYDROGENATION OF LOW RANK COAL

BACKGROUND OF THE INVENTION

1. Field of the Invention

This invention relates to a process for hydrogenating low rank coal to liquid and gaseous hydrocarbons.

2. Description of the Prior Art

A number of ebullated bed processes have been developed for the conversion of coal to liquid and gaseous hydrocarbons. These processes include one requiring two catalytic stages U.S. Pat. No. 3,700,584, a second process having a countercurrent transfer of catalyst from the second stage to the first stage (U.S. Pat. No. 3,679,573), and a single stage non-catalytic technique (U.S. Pat. No. 3,617,465). Satisfactory results can consistently be obtained with these methods with feeds other than low rank coals. However, when low rank coals are treated, conversion and, as a result, operability have not been satisfactory. These unsatisfactory results are caused by the relatively low hydrogenation rates of these coals and, in the case of the catalytic processes, by the rapid inactivation of the catalyst by the metallic impurities contained in the coal and carbon deposition.

SUMMARY OF THE INVENTION

It is the principal object of the present invention to provide a two stage process for the hydrogenation of low rank coal to produce hydrocarbon liquid and gaseous products wherein improved conversion and operability are achieved.

We have now discovered that by processing low rank coal in two reaction zones connected in series, with the first stage reactor attaining a limited degree of conversion of coal to tars and operating without catalyst, at significantly higher solids concentration and at a higher temperature than the second stage catalytic reactor, and the second stage reactor operating at temperatures and pressures designed to maximize hydrogenation of the tars to lighter liquid and gaseous hydrocarbons, improved operation and a significantly higher level of coal conversion can be achieved. The average temperature in the first stage non-catalytic reaction zone should exceed the average temperature in the second stage catalytic reaction zone by at least about 25° F. (~14° C.) but preferably, by not more than about 75° F. (~42° C.).

This temperature differential provides at least two significant advantages. First, since the hydrogenation rate is a function of reaction temperature, the higher temperature results in greater coal conversion. Second, the use of a lower temperature in the second stage decreases the amount of carbon deposited on the catalyst, thereby increasing catalyst life.

The temperature in the first stage reactor should preferably be about 825°–875° F. (~441°–468° C.), while the temperature in the second stage catalytic ebullated bed reactor should preferably be about 800°–850° F. (~427°–454° C.). Reactor pressure in both stages should be 1500–3500 psi (~100–240 atm) partial pressure of hydrogen, with the pressure in the first stage reactor usually being slightly higher than in the second stage to permit forward flow without pumping. The solids concentration of unconverted coal and ash in the first stage reactor should be controlled by recycle of clarified liquid to be about 15–30 weight percent, and the solids concentration in the second stage reactor should be maintained by clarified liquid recycle to be about 10–20 weight percent.

The first stage reactor may operate with or without the presence of a high density, non-catalytic contact material. The use of such contact material is desirable when the reactor is operated at the higher end of the temperature range since the material limits the deposition of coke. When contact material is used, it should consist of high density, low porosity solids, for example tabular alumina having a particle density of 3.0 gm/cc or higher.

The second stage catalyst may be any catalyst used in the hydrogenation of coal and is preferably selected from cobalt, molybdenum, nickel, tungsten, tin, and iron deposited on a base of $\gamma$-alumina, magnesia, and silica. Such catalyst particles generally have a density of less than 1 gm/cc.

DESCRIPTION OF THE DRAWING

The drawing is a diagrammatic view of a typical process suitable for the two stage hydrogenation of coal.

DESCRIPTION OF PREFERRED EMBODIMENT

Low rank coal, such as semi-bituminous, sub-bituminous, brown coal or lignite, is introduced at 10 into a preparation unit 12, wherein the coal is dried to remove substantially all surface moisture, ground to a desired size and screened. For the purpose of this invention, it is preferable that the coal have a particle size between about 20 to about 200 mesh (U.S. sieve series), i.e., the coal particles all pass through a 20 mesh screen and substantially all (not less than 80%) of the coal particles are retained on a 200 mesh screen. However, the preciseness of size may vary between different types of coal.

The coal particles are discharged at 14 into slurry tank 16 where the coal is blended with a slurrying oil introduced at 18. This oil is preferably a recycle stream produced by the hydrogenation of the coal. To establish an effective transportable slurry, the ground coal should be mixed with at least about an equal weight of slurrying oil, but usually with not more than 10 parts of oil per part of coal.

The coal-oil slurry is then pressurized by pump 20 and passed via line 21 through the slurry heater 22, where the slurry is heated to near reaction zone temperature. The heated slurry is then discharged at 24 into the first stage reactor feed line 26, wherein it may be supplied with heated makeup hydrogen from line 28 as well as recycled hydrogen from line 30.

The hydrogen and coal-oil slurry is then introduced into the first stage reactor 32. In this reactor the hydrogen/coal/oil mixture is maintained at a sufficient pressure and temperature for limited conversion of coal primarily to heavy liquid hydrocarbons without hydrogenating substantial amounts of the tars to lighter liquid and gaseous products. Hydrogenation is achieved in the first zone without the use of a catalyst. This eliminates the fluidization difficulties of prior art processes which used a catalyst in the first stage since only unreacted coal and ash particles are present in the bed. Alternatively, a high density contact material such as tabular alumina can be used and the first stage can be operated as an ebullated bed.

If the first stage is operated as an ebullated bed, liquid may be recycled internally within the reaction zone 32 to maintain ebullation. In such case, a standpipe 34 having its top end open and above the upper level of ebullation 38 may be used to pass liquid from the top of the reaction zone 32 to recycle pump 45 disposed below distributor 42 in the bottom of the reaction zone 32, with the liquid discharged by the submerged pump flowing upwardly again through the mass of ebullated solids. In lieu of distributor 42 which uniformly distributes the flow of liquid and gasiform material to the entire mass of ebullated solids in reaction zone 32, the bottom of the reactor may be tapered or funnel-shaped so that the admixed liquid and gasiform streams introduced into the bottom of the funnel will flow upwardly through the entire ebullated mass. When no contact material is contained in vessel 32 the standpipe 34 and pump 45 can be eliminated.

As a further alternative, the liquid may be recycled externally of the reaction zone 32. In such a case, the effluent line 48 can be connected to line 26 via a conduit and a pump (neither shown) to maintain the desired superficial upward liquid velocity in the reaction zone 32.

The operating conditions of temperature and pressure in the first stage reaction zone 32 are in the range of from about 800° F. (~427° C.) to about 900° F. (~482° C.), preferably from about 825° F. (~411° C.) to about 875° F. (~468° C.), and with a hydrogen partial pressure of from about 1500 to about 3500 psig (~100–240 atm).

If the first stage is operated as an ebullated bed, the gross density of the contact material in the first stage should preferably be between about 25 to about 100 pounds per cubic foot (~400–1600 g/l). The flow rate of the liquid should preferably be between about 5 and about 120 gallons per minute per square foot of horizontal cross-section of the ebullated mass (~200–4900 $l/min/m^2$), and the expanded volume of the ebullated mass should usually be no more than about double the volume of the settled mass and preferably about 30–80 percent greater.

After the coal-oil slurry is partially hydrogenated in the first stage reaction zone 32, the entire effluent stream, which comprises heavy tars of average molecular weight of 500–1000, containing 5–6.5% hydrogen, which are essentially non-volatile at 1000° F., partially unconverted coal, mineral matter, slurry oil, unconsumed hydrogen, gaseous and lighter liquid hydrocarbonaceous products and by-products of hydrogenation, is withdrawn from the top of reaction zone 32 via line 48 and fed to input conduit 50 of the second stage ebullated bed reaction zone 52. If needed, additional recycle hydrogen may be fed into the second stage reaction zone 52 via line 53. A hydrogenation catalyst bed is provided in the second stage reaction zone 52 by introducing fresh or uncontaminated catalyst via line 54. The partially spent or contaminated catalyst is withdrawn from the reaction zone 52 via line 56, and is replaced at a sufficient rate to maintain the desired catalytic activity in the second stage reaction zone 52. The spent catalyst may be regenerated by conventional techniques or discarded. The upper level of ebullation in reaction zone 52 is indicated at 58.

The catalyst used in the second stage is preferably cobalt, molybdenum, nickel, tungsten, or tin deposited on a base of $\gamma$-alumina having a particle density of less than 1 gm/cc. It is preferably in the form of beads, pellets, lumps, chips or like particles and has a size of at least about 1/32 inch (~0.08 cm) or more frequently in the range of 1/16 to ¼ inch (~0.16–0.64 cm) (i.e., between about 3 and 12 mesh screen on the U.S. sieve scale). The size and shape of the particles used in any specific process will depend on the particular conditions of that process, e.g., the density, velocity, and viscosity of the liquid involved in that process.

The second stage reaction zone 52 should be operated under the conditions of temperature, pressure, and liquid feed rate most suited to provide maximum hydrogenation of the tars to lighter liquid and gaseous hydrocarbons such as temperature of 775°–875° F. (~413°–468° C.) to preferably 800°–850° F. (~427°–454° C.). The temperature should preferably be at least 25° F. less than that of the first stage. Reactor 52 can be provided with a standpipe 60, circulation pump 62, and distributor 64 for internal recycle of liquid to maintain the desired superficial liquid velocity and ebullation. External recycle of liquid can alternatively be employed as in the first stage.

The coal feed rate through the first stage reaction zone 32 and the second stage reaction zone 52 is from about 15 to about 100 pounds per hour per total cubic foot of the two reaction zones 32 and 52. The total hydrogen feed rate to both the first and second stage reaction zone 32 and 52 is generally from about 20 to about 60 standard cubic feet per pound of coal and the separate hydrogen feed rate in each of said two zones is usually proportional to the zone volume or size thereof. The ratio of the volume or size of the first stage reaction zone 32 to the volume or size of the second stage reaction zone 52 generally is from about 1:3 to about 3:1 and preferably is about 1:2 to 1:1.

Thus, where the volume of the first stage reaction zone 32 is twice that of the second stage reaction zone 52 and where the total hydrogen feed rate through both of the two reaction zones 32 and 52 is about 30 standard cubic feet per pound of coal, the directly proportional separate hydrogen feed rate through the first stage reaction zone 32 is about 20 standard cubic feet per pound of coal and in the second stage reaction zone 52 is about 10 standard cubic feet per pound of coal.

It will be appreciated that the first and/or second stage reaction zones 32 and 52 can be a single ebullated bed reactor each or a plurality of ebullated bed reactors connected in parallel. For example, for reasons of economy in equipment costs the first stage reaction zone 32 can be two ebullated bed reactors arranged in parallel and the second stage reaction zone 52 can be a single ebullated bed reactor, with all three ebullated bed reactors being of equal size or volume. In such an arrangement, the ratio of volume or size of the first stage reaction zone to the volume or size of the second stage reaction zone would be 2:1 and where the total hydrogen feed rate to both the first and second stage reaction zones is about 30 standard cubic feet per pound of coal, the directly proportional separate hydrogen feed rate to each of the three equal volume reactors would be 10 standard cubic feet per pound of coal.

A gasiform effluent stream is withdrawn from the top of the second stage reaction zone 52 via line 66 and passed to a separator 70 wherein hydrocarbonaceous vapors, any entrained solids or liquids, by-product gases and excess hydrogen gas can be separated from one another to the extent desired and the recovered hydrogen gas recycled to the first stage reaction zone 32 via line 72. If desired, some recovered hydrogen gas can also be recycled to the second stage reaction zone via line 53.

A solids-containing liquid effluent stream is withdrawn from the second stage reaction zone 52 via line 68 and fed to separator 74 for separation and recovery of the hydrocarbonaceous liquid products and solids such as unconverted coal (char) and ash.

Overhead liquid stream 75 is passed to a distillation zone 76, from which light gas and liquid material is recovered as product at 77 and heavy liquid is withdrawn at 79.

The bottoms liquid stream 78 withdrawn from gas-liquid separation step 74 contains some particulate solids and is passed to a liquid-solids separation zone 80, which is preferably a liquid hydroclone separator unit. To help control the concentration of coal solids in the first stage reactor 32 within a desired range, overflow liquid 82 containing a reduced concentration of solids can be returned to the reactor 32 via slurrying liquid stream 18. A solids-enriched stream is withdrawn at 84 for further processing as desired, such as by vacuum distillation at 86 for further recovery of the oil portion. The overhead liquid stream 87 from the vacuum distillation may be combined with liquid stream 79 to provide blended liquid product 96.

If closer control of coal solids concentration in the second stage reactor 52 is needed in order to limit the solids concentration within the desired range, a portion of the clarified liquid stream 82 can be returned to the second stage reactor 52 via line 83. Any overhead liquid not recycled to the reactor can be passed via stream 85 to vacuum distillation at 86 or may be withdrawn via stream **85*a* as product 96. Heavy material is removed at 88**.

To assist in the separation and recovery of gaseous and liquid products from gaseous effluent stream 66 in separation system 70, it is preferable to cool the effluent stream 66 against at least a portion of recycle hydrogen stream 72 recovered in unit 70. Such cooling of the reactor gaseous effluent stream desirably reduces the heating requirements for the recycle hydrogen, as provided in heater 90. Specifically, gaseous effluent stream 66 withdrawn from second stage reactor 52 is preferably cooled against recycle hydrogen stream 92 in heat exchanger 93.

To assist in controlling temperature in the second stage reactor 52 within the desired range, effluent stream 48 from first stage reactor 32 may preferably be cooled against at least a portion 94 of recycle hydrogen stream 72 in heat exchanger 95. Such heat exchange with reactor effluent 48 also reduces the heating requirements for the recycle hydrogen as provided by heater 90.

An alternative and preferred arrangement for supplying the high purity makeup hydrogen to first stage reaction zone 32 is provided by introducing it via stream 29 immediately upstream of slurry heater 22. Introducing hydrogen into the slurry stream at this point reduces the liquid viscosity and thus facilitates heat transfer in heater 22. Also if desired, a portion of the warm recycle hydrogen may be similarly introduced via stream 31 upstream of slurry heater 22 to facilitate the slurry heating process.

Low rank coals for which this invention is useful include Wyodak, Big Horn, Black Mesa, Gelliondale, and Kaiparowits type coals.

An example of the results obtained by the claimed invention is given in the first column of the following tabulation. These results are contrasted with those obtained by alternative methods of processing the same coal in a two stage system with catalyst in both reactors (column 2), and in single stage systems with (column 3) and without (column 4) catalyst. The coal feed rate was 30 pounds per hour of Wyodak coal in each case and the hydrogen partial pressure was 1800 psig in the reactor effluent vapor stream. The recycled slurrying oil quantity and composition was adjusted in each case to maintain the slurry effluent concentration shown in order to remain within operable limits.

| System | 1. Two Stage | 2. Two Stage | 3. Single Stage | 4. Single Stage |
|---|---|---|---|---|
| First Stage | | | | |
| Volume | .333 | .667 | 1.000 | 1.000 |
| Containing Catalyst | No | Yes | Yes | No |
| Temperature, °F | 850 | 825 | 825 | 850 |
| First Stage Effluent | | | | |
| Solids, Wt% | 30 | 20 | 20 | 23 |
| Tars, Wt% | 30 | 15 | 15 | 37 |
| Distillable, Wt% | 40 | 65 | 65 | 40 |
| Second Stage | | | | |
| Volume | .667 | .333 | — | — |
| Containing Catalyst | Yes | Yes | — | — |
| Temperature, °F | 825 | 825 | — | — |
| Second Stage Effluent | | | | |
| Solids, Wt% | 20 | 20 | — | — |
| Tars, Wt% | 25 | 22 | — | — |
| Distillable, Wt% | 55 | 58 | — | — |
| Coal Conversion, Wt% of M.A.F. Coal | 94 | 84 | 81 | 91 |
| Liquid yields, Wt% of Dry Coal | | | | |
| Distillable Oils | 49 | 45 | 39 | 32 |
| Residual Oil | 14 | 11 | 14 | 27 |

I claim:

1. A two-stage process for the hydrogenation of low rank coal to produce hydrocarbon liquids and gaseous products, which comprises:

blending particulate low rank coal with a slurrying oil to form a pumpable coal-oil slurry, partially hydrogenating said coal by contacting said coil-oil slurry with hydrogen in a first stage reaction zone containing no catalyst, passing the entire effluent from said first zone to a second ebullated bed reaction zone, said effluent comprising the hydrogenation products formed and the coal which was only partially converted in said first zone, hydrogenating said effluent in said second zone in the presence of particulate hydrogenation catalyst, the temperature in said second zone being at least 25° F. less than the temperature in said second zone, and withdrawing a gaseous effluent stream and a liquid effluent stream from said second stage reaction zone.

2. The process of claim 1 wherein said first stage reaction zone is maintained at a temperature and a pressure which are sufficient to convert said coal primarily to heavy tars.

3. The process of claim 2 wherein said first stage reaction zone is maintained at a temperature of from about 800° to about 900° F. and at a hydrogen partial pressure of from about 1500 to about 3500 psig.

4. The process of claim 1 wherein said second stage reaction zone is maintained at a temperature of from about 775° to about 875° F. and at a hydrogen partial pressure of from about 1500 to about 3500 psig.

5. The process of claim 3 wherein said second stage reaction zone is maintained at a temperature of from about 775° F. to about 875° F. and at a hydrogen partial pressure of from about 1500 to about 3500 psig.

6. The process of claim 5 wherein the temperature of said second stage reaction zone is at least about 25° F. less than the temperature of said first stage reaction zone.

7. The process of claim 6 wherein the temperature of said first stage reaction zone is from about 825° to about 875° F. and the temperature of said second stage reaction zone is from about 800° to about 850° F.

8. The process of claim 1 wherein the solids concentration in said first stage reaction zone is higher than in said second stage reaction zone.

9. The process of claim 8 wherein the concentration of unconverted coal and ash solids in said first stage reaction zone is 15–30 weight percent, and the concentration of solids in said second stage reaction zone is 10–20 weight percent.

10. The process as defined by claim 1 wherein said first stage reaction zone contains a non-catalytic high density contact material and is operated as an ebullated bed.

11. A two-stage process for the hydrogenation of low rank coal to produce hydrocarbon liquids and gaseous products, which comprises:

blending particulate low rank coal with a slurrying oil to form a pumpable coal-oil slurry, partially hydrogenating said coal by contacting said coal-oil slurry with hydrogen in a first-stage reaction zone, said reaction zone containing no catalyst and being maintained at a temperature and pressure which is sufficient to convert the coal primarily to heavy tars, passing the entire effluent from said first zone to a second ebullated bed reaction zone, said effluent comprising the heavy tars formed and the coal which was only partially converted in said first zone, hydrogenating, in said second zone, the entire effluent, said second zone containing a particulate hydrogenation catalyst and being maintained at a temperature which is at least about 25° F. lower than the temperature in said first-stage reaction zone, and withdrawing a gaseous effluent stream and a liquid effluent stream from said second-stage reaction zone.

12. The process of claim 11 wherein the temperature of said first stage reaction zone is from about 800° to about 900° F., the temperature of said second stage reaction zone is from about 775° to about 875° F. and the hydrogen partial pressure in both said first and second stage reaction zones is from about 1500 to about 3500 psig.

13. The process of claim 12 wherein the temperature of said first stage reaction zone is from about 825° to about 875° F. and the temperature of said second stage reaction zone is from about 800° to 850° F.

14. The process of claim 1 wherein said particulate coal is blended with at least about an equal weight of slurrying oil.

15. The process of claim 14 wherein the coal-oil slurry contains no more than ten parts of slurrying oil per part of oil.

16. The process of claim 10 wherein said contact material has a density of at least 3.0 g/cm$^3$.

17. The process of claim 1 wherein the coal is Wyodak, Big Horn, Black Mesa, Gelliondale or Kaiparowits type coals.

18. The process of claim 11 further comprising the steps of recovering gaseous hydrocarbon and hydrogen from the gaseous effluent stream, recycling at least a portion of the hydrogen recovered to said first zone, and separating a slurrying oil from said liquid effluent stream, said slurrying oil being recycled and blended with particulate coal before said coal is hydrogenated in said first zone.

19. The process of claim 18 wherein said effluent from said first stage is cooled against at least a portion of the recycled hydrogen.

20. The process of claim 18 wherein said gaseous effluent stream is cooled against at least a portion of the recycled hydrogen.

21. A two-stage process for the hydrogenation of low rank coal to produce hydrocarbon liquids and gaseous products which comprises:

blending particulate low rank coal with a slurrying oil to form a pumpable coal-oil slurry, partially hydrogenating said coal by contacting said coal-oil slurry with hydrogen in a first stage reaction zone containing no catalyst, the concentration of unconverted coal and ash solids in said first reaction zone being maintained at about 15–30 weight percent, passing the entire effluent from said first zone to a second ebullated bed reaction zone, said effluent comprising the hydrogenation products formed and the coal which was only partially converted in said first zone, hydrogenating said entire effluent in said second zone, said second zone containing particulate hydrogenation catalyst and being maintained at a temperature which is at least about 25° F. lower than the temperature in said first zone and having a solids concentration of about 10–20 weight percent.

* * * * *

Notice of Adverse Decision in Interference

In Interference No. 100,462, involving Patent No. 4,111,788, M. C. Chervenak and E. S. Johanson, STAGED HYDROGENATION OF LOW RANK COAL, final judgment adverse to the patentees was rendered July 20, 1981, as to claims 1-9, 11-15, 18 and 21.

[*Official Gazette November 3, 1981.*]